US005440366A

United States Patent [19]

Reiss et al.

[11] Patent Number: 5,440,366

[45] Date of Patent: Aug. 8, 1995

[54] MULTI-PAD FILM PROCESSING

[75] Inventors: Wanda Reiss, Lexington; Vincent L. Cocco, Wakefield, both of Mass.

[73] Assignee: Polaroid Corporation, Cambridge, Mass.

[21] Appl. No.: 279,505

[22] Filed: Jul. 22, 1994

[51] Int. Cl.[6] ..... G03D 9/00

[52] U.S. Cl. ..... 354/301; 354/303; 354/318; 354/88; 354/86

[58] Field of Search ..... 354/86, 88, 303, 304, 354/317, 318, 275, 301; 355/27–29

[56] References Cited

U.S. PATENT DOCUMENTS

| | | | |
|---|---|---|---|
| 4,370,045 | 1/1983 | Holmes | 354/313 X |
| 4,435,062 | 3/1984 | Cocco | 354/318 X |
| 4,516,844 | 5/1985 | Kee et al. | 354/313 X |

*Primary Examiner*—D. Rutledge

*Attorney, Agent, or Firm*—Robert A. Sabourin; Edward S. Roman

[57] ABSTRACT

A photographic film image carrying element is housed in a cartridge having a strip wound around a spool in the cartridge, where the strip includes a leader protruding from the cartridge, the image carrying element, a leader barrier for physically and chemically separating the leader from the image carrying element, a first reagent laden web, a first barrier for physically and chemically separating the image carrying element from the first reagent laden web, a second reagent laden web, and a second barrier for physically and chemically separating the first reagent laden web from the second reagent laden web. The second reagent laden web is attached to the spool. The photographic film image carrying element can be processed by: winding the image carrying element onto a first take-up reel; merging the image carrying element and the first reagent laden web by guiding the strip at the first barrier through a set of rollers then winding the merged image carrying element and first reagent laden web onto a second take-up reel; rewinding and separating, after a first predetermined time, the image carrying element onto the first take-up reel and the first reagent laden web onto the spool in the cartridge; winding the first reagent laden web onto the first take-up reel; merging the image carrying element and the second reagent laden web by guiding the strip at the second barrier through the set of rollers, then winding the merged image carrying segment and second reagent laden web onto the second take-up reel; rewinding and separating, after a second predetermined amount of time, the image carrying element onto the first take-up reel and the second reagent laden web onto the spool in the cartridge; and scanning the image carrying element with a light beam while rewinding the image carrying element onto the spool.

9 Claims, 5 Drawing Sheets

MULTI-PAD FILM PROCESSING

BACKGROUND OF THE INVENTION

1. Field of the Invention

The invention relates generally to an improved photographic film cartridge and processing techniques thereto. More particularly, the invention relates to a multi-pad photographic film cartridge, a processor for processing the multi-pad photographic film cartridge, and a processing technique for processing the multi-pad photographic film cartridge in the processor.

2. Description of the Prior Art

Pad processing, i.e. processing using a web or pad, is well known in the art of image processing. Sometimes the pad is saturated with processing chemicals and at other times, the processing chemicals are stored in a rupturable pod. When the pod is ruptured, the processing chemicals are spread across the web as a first step towards film development. Many variations of pad processing have been exercised over the years although typically a singular processing web (i.e. monopad) is combined with a film for film development. However in order to process a film using a monopad, both the film structure and the processing chemicals within the monopad become very complicated in order to accommodate the numerous processing steps such as developing, fixing and bleaching. Generally, a specific film is modified so that it can be easily processed using a particular processing pad. The start up and production costs for manufacturing each film and complementary processing pad are relatively high. Furthermore, no monopad is currently known which can be universally used for processing many different types of film with acceptable results.

In U.S. Pat. No. 4,370,045 issued 25 Jan. 1983 to Holmes, a film processor is disclosed which allows processing of 35 mm instant type transparency film by use of a processing kit which contains a housing comprised of two sections, one of which is moveable between open and closed positions, a roller having a length of flexible sheet material wound thereupon, a container of processing fluid and a dispenser. During processing, the processing fluid is transferred from a pod to a dispenser which then coats the sheet material with the processing fluid. The film and sheet material are merged together and wound onto a take-up reel. After the processing fluid has saturated the film for a predetermined period of time (long enough to promote film development), the sheet material and the developed film are separated and rewound onto the appropriate spools. However, the disclosed method is for the processing of 35 mm instant type transparency film using a single web with the particular processing fluid stored in a rupturable pod.

The concept of providing a processing fluid within a film cassette (such as a standard sized 35 mm cassette) was disclosed by Kee et at. in U.S. Pat. No. 4,516,844 issued 14 May 1985. After exposure of the film in a camera, the film is rewound into the cassette and a force is applied to a support journal which is connected to a piston that ruptures ports for allowing the processing fluid to enter a chamber where the film is housed. The processing fluid saturates the film for a predetermined period of time then, the developed film is removed from the cassette. However, patent '844 requires the use of a particular liquid processing fluid which must be stored within the cassette. Different films require different processing fluids for development.

Consequentially, it is a primary object of the current invention to overcome the above and other shortcomings in the prior art by teaching the processing of any standard film (such as 35 mm film) using multiple reagent laden processing pads stored either in the film cassette or in an auxiliary cassette.

Other objects of the invention will, in part, appear hereinafter and, in part, be obvious when the following detailed description is read in conjunction with the drawings.

SUMMARY OF THE INVENTION

A photographic film negative (i.e. an image carrying element) is housed in a cartridge having a strip wound around a spool where the strip includes a leader protruding from the cartridge, the negative, a leader barrier for physically and chemically separating the leader from the negative, a first reagent laden web, a first barrier for physically and chemically separating the negative from the first reagent laden web, a second reagent laden web, and a second barrier for physically and chemically separating the first reagent laden web from the second reagent laden web. The second reagent laden web is either attached directly to the spool or separated from the spool by a spool barrier. The photographic film negative can be processed by: winding the negative onto a first take-up reel; merging the negative and the first reagent laden web by guiding the strip at the first barrier through a set of rollers then winding the merged negative and first reagent laden web onto a second take-up reel; rewinding and separating, after a first predetermined time, the negative onto the first take-up reel and the first reagent laden web onto the spool in the cartridge; winding the first reagent laden web onto the first take-up reel; merging the negative and the second reagent laden web by guiding the strip at the second barrier through the set of rollers then winding the merged image carrying segment and second reagent laden web onto the second take-up reel; rewinding and separating, after a second predetermined amount of time, the negative onto the first take-up reel and the second reagent laden web onto the spool in the cartridge; and scanning the negative with a light beam while rewinding the negative onto the spool in the cartridge to acquire an electronic record of the image in it.

BRIEF DESCRIPTION OF THE DRAWINGS

The aforementioned aspects and other features of the invention are described in detail in conjunction with the accompanying drawings (not drawn to scale) in which the same reference numerals are used throughout for denoting the elements of the invention and wherein.

DETAILED DESCRIPTION OF THE PREFERRED EMBODIMENTS

Standard film cartridges, i.e. film cartridges which are currently commercially available, contain films which can be developed and processed using a multi-pad processing technique where each separate pad operates like a separate bath in a photographic film processing lab. For example, a first processing step such as developing could take place when a first pad imbibed with chemical developers is combined with the exposed film for an appropriate length of time. After the first pad is separated from the film, a second processing step such as fixing could take place by combining the film with a second pad imbibed with fixing chemicals for an appropriate length of time, then separating the second pad from the film. Thereafter, a third processing step such as bleaching could be accomplished by combining a third processing pad imbibed with bleaching chemicals with the film for an appropriate length of time, then removing the third pad from the film. Of course, the number of pads used for processing would vary according to the number of processing steps desired.

Figure 1:
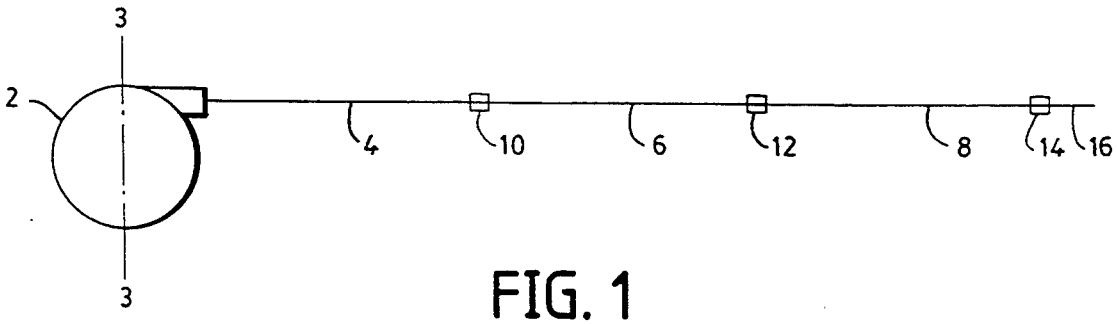
FIG. 1 is a diagrammatic representation of an unwound photographic film cartridge showing a strip which includes a film connected to multiple processing pads according to the invention.

The packaging of multi-pads for photographic film processing includes storing the pads in the same cartridge as the film (see FIGS. 1, 2, and 3A–3G), storing the pads in a separate processing cartridge (see FIG. 4A–4C), or storing the pads in a cartridge similar to that of a standard film cartridge. FIG. 1 shows a film and pads completely unwound from the cartridge 2 whereas FIG. 2 shows the film and pads completely wound onto the cartridge 2.

The film cartridge 2 of FIGS. 1, 2 and 3A–3G is a preferred embodiment of a conventional sized cartridge which fits into existing cameras, although variations in the cartridge size could be realized if desired. The contents of the film cartridge 2 in FIGS. 1 and 2 include a photographic film 8, a first reagent laden processing web 6, and a second reagent laden processing web 4. A spool barrier 22 is connected between a spool 20 and the second web 4 to physically and chemically isolate the two components. A second barrier 10 is connected between the second web 4 and the first web 6 to physically and chemically isolate the two components. A first barrier 12 is connected between the first web 6 and the film 8, and a leader barrier 14 is connected between the film 8 and a leader 16. Each of the barriers 22, 10, 12 and 14 can be constructed of any material which will not react to the chemicals absorbed within the webs and which is strong enough and flexible enough to be wound on and off the spool 20. Foil is an excellent barrier material. The leader 16 remains outside of the film cartridge 2 to allow easy access to the film.

Figure 2:
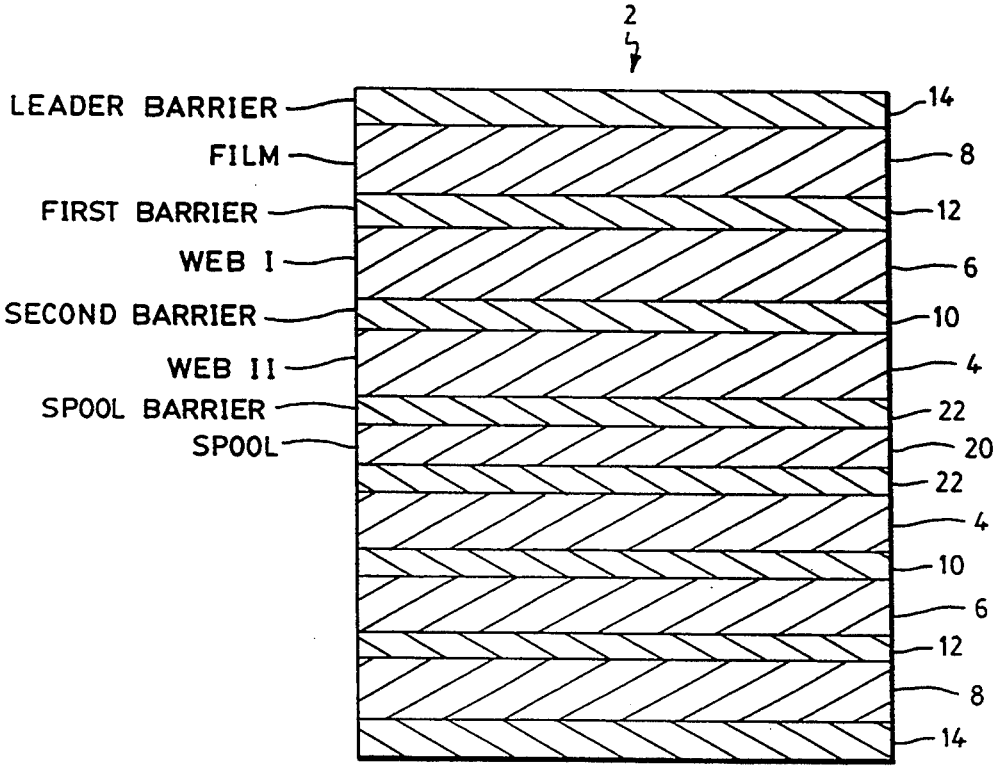
FIG. 2 is an enlarged cross-sectional elevational view of the photographic film cartridge of FIG. 1 with the film and processing pads wound onto a spool and is equivalent to being taken generally above line 3—3 of FIG. 1 with the film inside.

In FIGS. 1 and 2, a spool barrier 22 is wound about and connected at one end to the spool 20. The other end of the spool barrier 22 is connected to one end of the second web 4. Another end of the second web 4 is connected to one end of the second barrier 10. The other end of the second barrier 10 is connected to one end of the first web 6, which is connected at another end to one end of the first barrier 12. The other end of the first barrier 12 is connected to one end of the film 8. The other end of the film 8 is connected to a leader barrier 14 which in turn is connected to the leader 16.

Figure 3A:
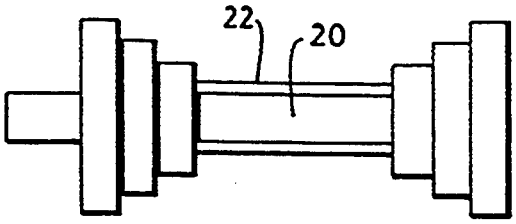
FIGS. 3A–3G illustrate the packaging of each layer of a standard 35 mm integral film cartridge using two webs and a film in accordance with the invention.
Figure 3B:
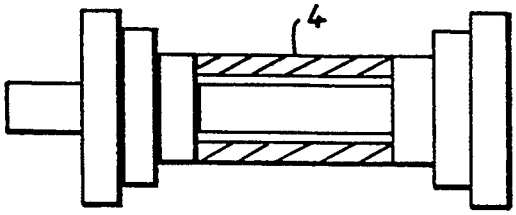
Figure 3C:
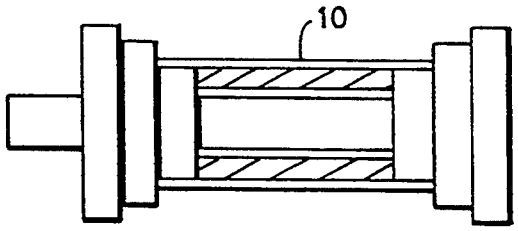
Figure 3D:
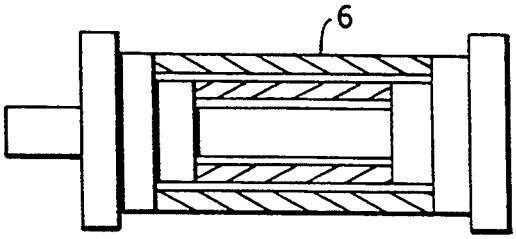
Figure 3E:
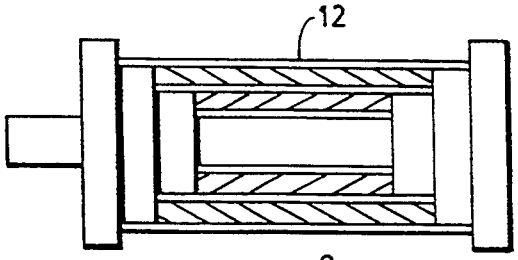
Figure 3F:
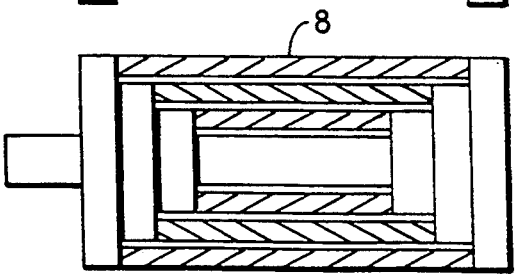
Figure 3G:
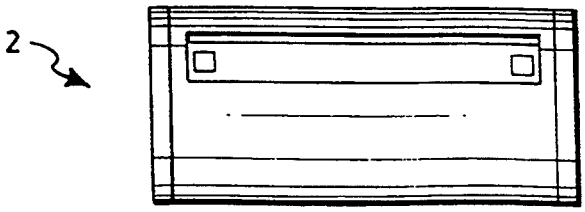

FIG. 3A–3G shows the packaging of a film and two processing webs within a standard sized Polaroid 35 mm cassette. In FIG. 3A, the spool barrier 22 is shown as wrapped around spool 20. Next, the second processing web 4 is connected to the spool barrier 22 in FIG. 3B followed by the second barrier 10 in FIG. 3C, the first processing web 6 in FIG. 3D, the first barrier 12 in FIG. 3E, and the film 8 in FIG. 3F. The leader barrier 14 and the leader 16 (both shown in FIG. 1 but absent from FIG. 3) could be packaged in a similar manner to the other barriers with the leader extruding from the cartridge for user access to the film. FIG. 3G shows the final product, i.e. a standard sized cassette, which is ready for use.

Each of the barriers 22, 10 and 12 consists of a material such as metalized foil which serves to physically and chemically separate the various layers of the cartridge and to assure stability from both moisture and atmospheric $CO_2$ absorption. It is possible that the foil lining of the spool barrier 22 may not be necessary if the spool material can be selected to offer similar protection.

Figure 4A:
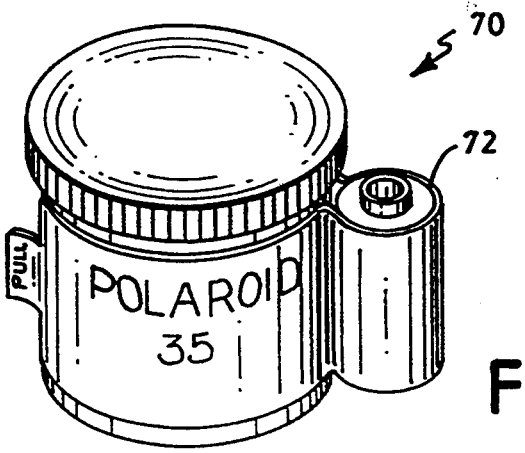
FIGS. 4A–4C illustrate, according to the invention, the packaging of a standard 35 mm integral film cassette and a processing cartridge, where both the film cartridge and the processing cartridge are housed within a single container.
Figure 4B:
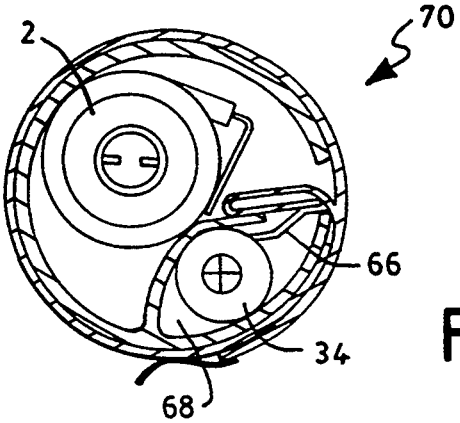
Figure 4C:
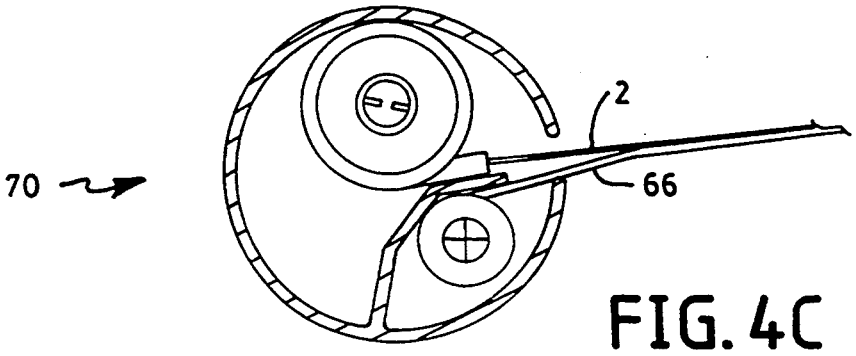

A standard 35 mm cartridge can contain enough materials for a limited number of exposures (i.e. film and processing webs). At times, however, it may be desirable to provide a greater number of exposures on the film or to be able to develop any film in a standard cartridge. In this case, the standard sized cassette 2 is housed within a container 70 as shown in FIGS. 4A–4C. The processing cartridge 34 is also housed within the container 70, and a spare take-up spool 72 for film processing is attached as shown. Alternatively, the webs are housed in a separate container, similar to the arrangement shown in FIGS. 1–3, but without film 8.

Figure 5:
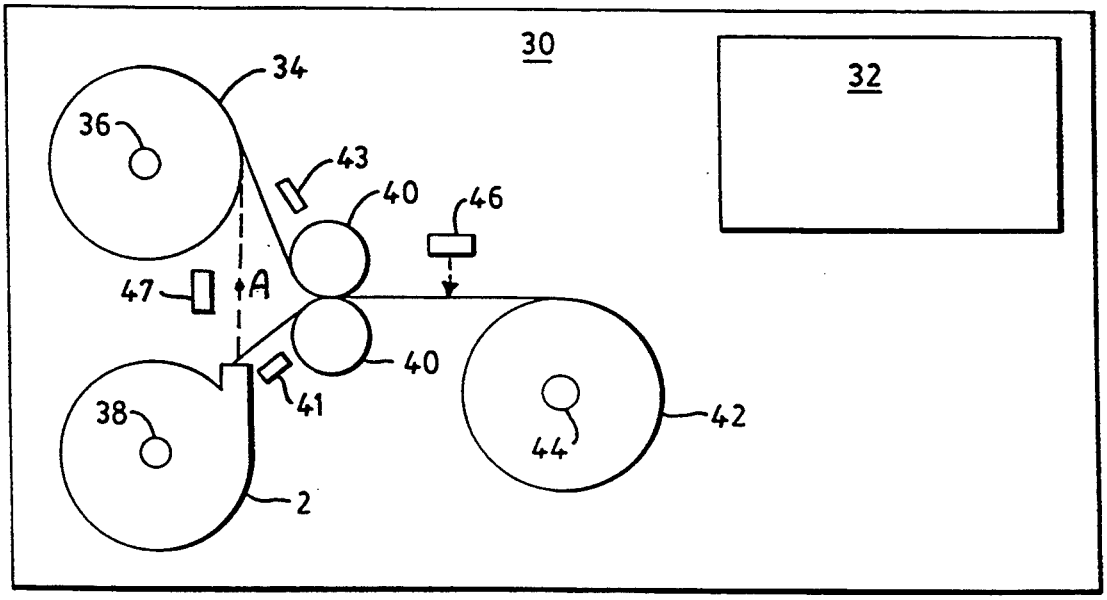
FIG. 5 is a diagrammatic elevational view of a first embodiment of a film processor according to the present invention.

A photographic film processor 30 for processing the film 8 of cartridge 2 is shown in FIG. 5. The processor 30 includes: a first drive shaft 38 for winding and rewinding the film and webs of cartridge 2; a second drive shaft 36 for winding and rewinding a first spool 34; a third drive shaft 44 for winding and rewinding a second spool 42; rollers 40; a scanner 46 or 47; detectors 41 and 43; and a controller 32 for controlling the various sequences of winding and rewinding each spool. Only a single scanner is required although multiple scanners could be utilized if desired. The scanner could be positioned in various locations within the processor as illustrated by scanners 46 and 47.

For a cartridge containing two webs, the length of the film 8 is approximately one-third of the combined length of the film 8, first web 6 and second web 4. Similarly, the first web 6 and the second web 4 each have lengths running approximately one-third of the combined length of the film 8, first web 6 and second web 4. First, second and leader barriers 12, 10 and 14, respectively, each include a code which is used to distinctly identify the location of the appropriate barrier. Additionally, a code or other type of detection utility is located on the first web 6 at the midpoint between first barrier 12 and second barrier 10. The above codes are detected by devices such as detectors 41 and 43.

In order to process the film 8 with the processor 30 of FIG. 5, the film cartridge 2 is first placed onto the first drive shaft 38 and the leader 16 (see FIG. 1) is rolled onto first spool 34. The film 8 is rolled from cartridge 2 to first spool 34 until the code of first barrier 12 is detected by detector 41 or 43 and stopped at position A as shown on the dotted line in FIG. 5. Then, a feed mechanism (not shown) feeds the first barrier 12 at point A between rollers 40 which press together film 8 and first web 6 so that the processing fluids imbibed in web 6 begin penetration of film 8. The combined film and web is wound onto second spool 42 by third drive shaft 44, which stops when either the code of second barrier 10 or the code of leader barrier 14 is detected by detector 41 or 43, respectively, indicating that the film 8 has been combined entirely with the first web 6. Film 8 and first web 6 remain combined for a first predetermined length of time adequate to properly saturate the film 8 with the chemicals imbibed in first web 6. After the first predetermined length of time has passed, first drive shaft 38 and second drive shaft 36 rewind the first web 6 and the film 8, respectively, onto film cartridge 2 and first spool 34 until the barrier code of second barrier 12 is again detected at point A by detector 41 or 43. Next, film 8 and first web 6 are both wound onto first spool 34 until the code positioned midway between first and second barriers 10 and 12 is located and stopped at point A. The first web 6 is fed into the rollers 40 from the location of point A and wound about second spool 42 until the film 8 is completely meshed with the second web 4. The chemicals within the second web 4 are allowed to saturate the film 8 for a predefined length of time. After the predefined length of time, the film and webs are separated by rewinding onto the cartridge 2 and first spool 34 until the code midway between the first and second barriers 10 and 12 on the second web 6 is again positioned at point A. The film and webs are finally rewound from first spool 34 to film cartridge 2, and scanner 47 scans the film for digital conversion during the final rewind. Multiple scanners for acquiring color information could be utilized if desired.

A second embodiment includes a standard commercial film cartridge 2 containing only film—no processing webs, and a processing cartridge, i.e. first spool 34, containing two or more reagent laden webs. In processor 30, the film of cartridge 2 is meshed together through rollers 40 with a first web from first spool 34, then wound onto second roller 42. After a first predetermined time adequate for the chemicals imbibed in the first web to saturate and react with the appropriate layers of the film, the film and first web are separated by rewinding back onto film cartridge 2 and first spool 34, respectively. Next, the first web is wound from first spool 34 through rollers 40 onto second spool 42 until a first barrier signifying the end of the first web is detected. At that point a second web connected to the first barrier is meshed with the film of cartridge 2 through rollers 40 and onto second spool 42 where it remains for a second predetermined period of time adequate for the chemicals imbibed in the second web to penetrate and react with the appropriate layers of the film. The film and second web are separated and rewound onto cartridge 2 and first spool 34, respectively, whereupon the second web of the first spool 34 is again wound through rollers 40 onto second spool 42 until a second barrier separating the second web and a third web is detected. From this point on, the third (and any subsequent) webs and the film could be meshed in the same manner as previously described for meshing the film with the second web. After the last web is meshed with the film for a final predetermined period of time, the film and webs are separated and rewound onto cartridge 2 and first spool 34, respectively. The film from cartridge 2 can then be wound onto second spool 42 and scanned by scanner 46 if desired.

Figure 6:
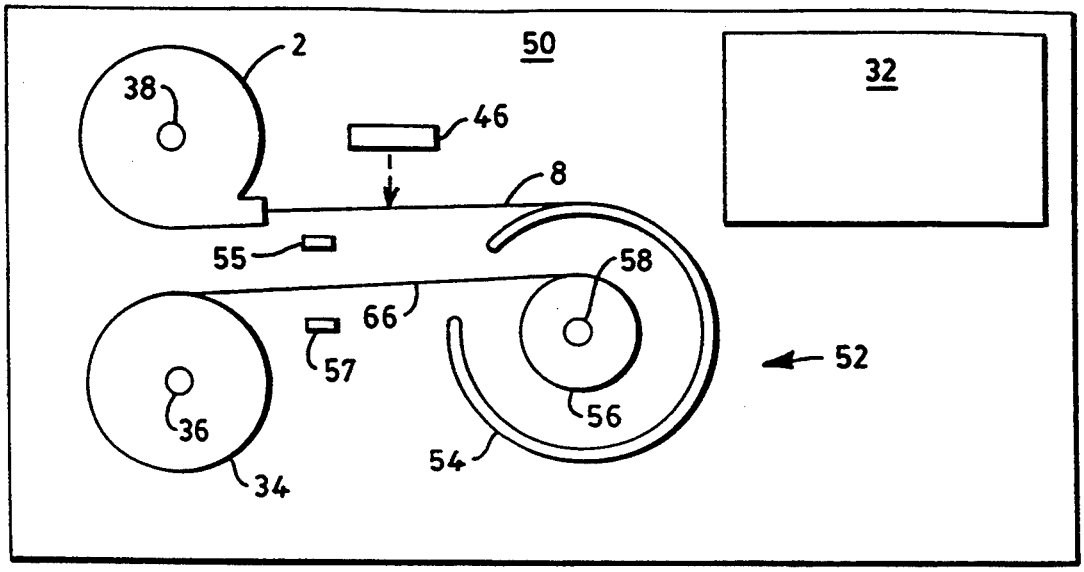
FIG. 6 is a diagrammatic elevational view of a second embodiment of a film processor according to the present invention.

FIG. 6 shows an alternative embodiment of a film processor 50 which includes: a first drive shaft 38 for winding and rewinding film cartridge 2; a second drive shaft 36 for winding and rewinding a first spool 34; a spool assembly 52 for merging a film and reagent laden web; a scanner 46 for scanning the film with light; and a controller 32 for controlling the sequence of operations of each of the components of the film processor 50. The spool assembly 52 includes a third drive shaft 58 for winding and rewinding film and web onto the small take-up reel 56 and the large take-up reel 54. The film processor 50 operates as follows for processing a film housed in cartridge 2 with two or more reagent laden webs housed in first spool 34.

As shown in FIG. 6, the film from film cartridge 2 is connected to large take-up reel 54 and one end of the first web is connected to small take-up reel 56. Then, small take-up reel 56 and large take-up reel 54 are locked together or otherwise rotated simultaneously in the same direction by third drive shaft 58 until the film is completely meshed with the first web along the outer surface of large take-up reel 54. The end of the film can be detected, for instance, by a detector 55 or, a first barrier code located on a first barrier separating the first web from a second web can be detected, for instance, by a detector 57. Any known means of detection can be used to detect the proper location for stopping the winding or rewinding of the film and webs, so that each web will be accurately aligned with the film for meshing. After a predetermined time adequate for the chemicals imbibed in the first web to penetrate the necessary layers of the film, the film and first web are separated by rewinding the film onto the film cartridge 2 and rewinding the first web onto the first spool 34 until only the ends of the film and first web are still connected to the large take-up reel 54 and the small take-up reel 56, respectively. The gap in the large take-up reel 54 should be positioned as shown in FIG. 6. At this time the large take-up reel 54 remains stationary and the small take-up reel 56 winds the first web from first spool 34 until the first barrier code, located on the first barrier and separating the first web from the second web, is detected by detector 57. Detection of the first barrier code ensures proper alignment of the second web with the film. The small take-up reel 56 and the large take-up reel 54 are then jointly engaged via the third drive shaft 58 and the spool assembly 52 is rotated to wind and mesh together the film and second web onto the large take-up reel 54 until a second barrier code is located on a second barrier which separates the second web from the third web. The drive shafts are all stopped for a predetermined time adequate for the chemicals imbibed in the second web to penetrate the appropriate layers of the film, then the film and the second web are separated by rewinding the film onto the film cartridge 2 while simultaneously rewinding the second web onto the first spool 34. The rewinding continues until the detector 57 detects the first barrier code on the first barrier. At that time all the drive shafts are stopped, the film has been treated with processing chemicals from two webs, the end of the film is connected to the large take-up reel 54, and the first web remains wound upon the small take-up reel 56. The third drive shaft 58 locks onto the small take-up reel 56 while disengaging large take-up reel 54 so that the second web is wound through the gap of the large take-up reel 54 from the first spool 34 until the second barrier code located on the second barrier, which separates the second web from the third web, is detected by detector 57. When the second barrier code is detected, all the drive shafts stop and the film and third web are ready to be meshed. The above procedures are then repeated for the third and any additional processing webs. Finally, the film is completely rewound onto the cartridge 2, and the large take-up reel 54 is disengaged from the third drive shaft 58 in a position approximate to that shown in FIG. 6 whereby all of the webs can be rewound onto the first spool 34 from the small take-up reel 56 through the gap in the large take-up reel 54 and disconnected from the small take-up reel 56. At this time the chemical development of the film is complete and the film can be scanned by scanner 46 while winding onto the large take-up reel 54. The developed film can be scanned as many times as desired by processor 50.

In some instances, such as when the film is being processed using moist pads, film contamination could occur from repeated scraping of the film through a light seal which is used to prevent light from entering the cartridge 2 and is located where the film enters the cartridge 2. To prevent this type of film contamination, the film processor 50 of FIG. 6 could be adapted as shown in FIG. 7.

Figure 7:
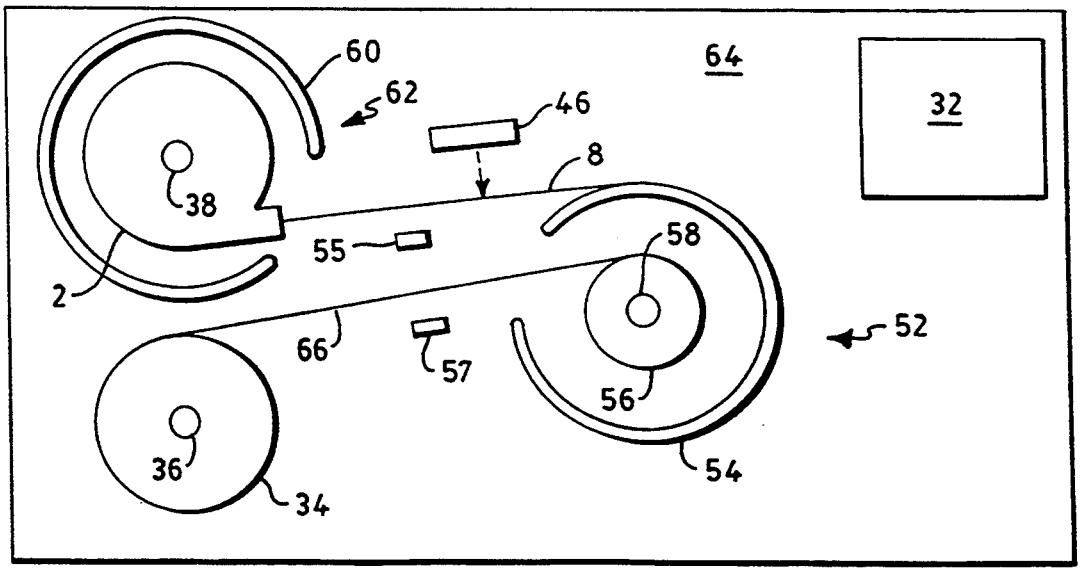
FIG. 7 is a diagrammatic elevational view of a third embodiment of a film processor according to the present invention.

The improvement in FIG. 7 (over FIG. 6) includes using a spool assembly 62 so that the film is only wound and rewound to and from cartridge 2 once. For instance, the end of the film is connected to the large take-up reel 54, the web is connected from first spool 34 to small take-up reel 56, and the film and first web are wound onto the large take-up reel 54 until the first code is detected on the first barrier separating the first and second webs. All the drive shafts are stopped for the first predetermined period of time until the chemicals imbibed in the first web penetrate through the appropriate layers of the film. Then, the film and first web are separated by rewinding the first web onto the first spool 34 and rewinding the film onto the large take-up reel 60. This is done by engaging both film cartridge 2 and large take-up reel 60 together with first drive shaft 38. Throughout the various steps of the film processing, the film is wound onto and from the large take-up reel 60 until finally the film is completely rewound back into cartridge 2. In this manner, the film is only once wound and rewound through the light seal (not shown) thus minimizing film scraping and contamination.

The above embodiments of novel methods and devices are preferred examples of the many variations and modifications which would be apparent to one of ordinary skill in the art in keeping with the invention as claimed. For instance, one of ordinary skill would know how to detect the barriers between the webs and/or the film as described in conjunction with the processor 30 of FIG. 5. Similarly, one of ordinary skill in the art would know that the length of the barriers could vary as necessary to implement the invention.

What is claimed is:

1. A photographic film cartridge comprising a strip wrapped around a spool, said strip comprising a leader protruding from said cartridge, an image carrying segment, a leader barrier for physically and chemically separating said leader from said image carrying segment, a first reagent laden web to be joined for a first predetermined period of time with said image carrying segment during a first processing step for processing of the image carrying segment, a first barrier for physically and chemically separating said image carrying segment from said first reagent laden web, a second reagent laden web to be joined for a second predetermined period of time with said image carrying segment during a second processing step for further processing of the image carrying segment, a second barrier for physically and chemically separating said first reagent laden web from said second reagent laden web, said second reagent laden web being attached to said spool.

2. The photographic film cartridge of claim 1, further comprising a spool barrier for separating said spool from said second reagent laden web.

3. An image processing cartridge comprising:

a spool;

a first reagent laden pad for providing a first film processing step when combined with an image carrying element;

a second reagent laden pad for providing a second film processing step when combined with said image carrying element; and a barrier connected between said first and second reagent laden pads for physically and chemically separating said first and second reagent laden pads.

4. A photographic film cartridge comprising:

a spool;

an image carrying element;

a first reagent laden pad for providing a first film processing step when combined with the image carrying element;

a second reagent laden pad for providing a second film processing step when combined with said image carrying element;

a first barrier connected between said first and second reagent laden pads for physically and chemically separating said first and second reagent laden pads; and a second barrier connected between said image carrying element and said second reagent laden pad for physically and chemically separating said second reagent laden pad from said image carrying element.

5. The photographic film cartridge of claim 4, further comprising a spool barrier connected between said spool and said first reagent laden pad for physically and chemically separating said spool from said first reagent laden pad.

6. A photographic film processing method comprising the steps of:

providing a strip wound around a spool in a film cartridge, said strip comprising a leader protruding from said cartridge, an image carrying segment, a leader barrier for physically and chemically separating said leader from said image carrying segment, a first reagent laden web, a first barrier for physically and chemically separating said image carrying segment from said first reagent laden web, a second reagent laden web, a second barrier for physically and chemically separating said first reagent laden web from said second reagent laden web, said second reagent laden web being attached to said spool;

merging said image carrying segment and said first reagent laden web for a first predetermined period of time;

separating, after said first predetermined amount of time, said image carrying segment and said first reagent laden web;

merging said image carrying segment and said second reagent laden web for a second predetermined period of time;

separating, after said second predetermined amount of time, said image carrying segment and said second reagent laden web; and scanning said separated image carrying segment after said second predetermined period of time with a light beam.

7. A photographic film processing method comprising the steps of:

providing a strip wound around a spool in a film cartridge, said strip comprising a leader protruding from said cartridge, an image carrying segment, a leader barrier for physically and chemically separating said leader from said image carrying segment, a first reagent laden web, a first barrier for physically and chemically separating said image carrying segment from said first reagent laden web, a second reagent laden web, a second barrier for physically and chemically separating said first reagent laden web from said second reagent laden web, said second reagent laden web being attached to said spool;

winding said image carrying segment onto a first take-up reel;

merging said image carrying segment and said first reagent laden web by guiding said strip at the first barrier through a set of rollers, and winding said merged image carrying segment and first reagent laden web onto a second take-up reel;

rewinding and separating, after a first predetermined amount of time, said image carrying segment onto the first take-up reel and said first reagent laden web onto the spool in the film cartridge;

winding said first reagent laden web onto said first take-up reel;

merging said image carrying segment and said second reagent laden web by guiding said strip at the second barrier through the set of rollers, and winding said merged image carrying segment and second reagent laden web onto the second take-up reel;

rewinding and separating, after a second predetermined amount of time, said image carrying segment onto the first take-up reel and said second reagent laden web onto the spool in the film cartridge; and scanning said image carrying segment with a light beam while rewinding said image carrying segment onto the spool.

8. A photographic film processor comprising:

a first drive shaft for accepting and driving a film cartridge including a spool with a strip wound around said spool, said strip comprising a leader protruding from said cartridge, an image carrying segment, a leader barrier for physically and chemically separating said leader from said image carrying segment, a first reagent laden web, a first barrier for physically and chemically separating said image carrying segment from said first reagent laden web, a second reagent laden web, a second barrier for physically and chemically separating said first reagent laden web from said second reagent laden web, said second reagent laden web being attached to said spool;

a second drive shaft for accepting and driving a first take-up reel;

a third drive shaft for accepting and driving a second take-up reel;

a set of rollers;

a scanner for scanning said image carrying segment; and means for controlling said first drive shaft, said second drive shaft, said third drive shaft, said set of rollers, said scanner.

9. A photographic film processing method comprising the steps of:

providing an image carrying element in a film cartridge;

providing a processing strip in a processing cartridge, said processing strip comprising a first reagent laden web, a second reagent laden web, and a barrier connected to both said first reagent laden web and said second reagent laden web for physically and chemically separating said first reagent laden web from said second reagent laden web;

merging said image carrying element and said first reagent laden web for a first predetermined period of time;

separating, after said first predetermined amount of time, said image carrying element and said first reagent laden web;

merging said image carrying element and said second reagent laden web for a second predetermined period of time;

separating, after said second predetermined amount of time, said image carrying element and said second reagent laden web; and scanning said separated image carrying element after said second predetermined period of time with a light beam.

* * * * *